United States Patent [19]

Collins

[11] 4,205,466

[45] Jun. 3, 1980

[54] CARRIERS FOR STUDS FOR FOOTWEAR

[75] Inventor: Roy S. Collins, Sutton Coldfield, England

[73] Assignee: Triman Limited, Tamworth, England

[21] Appl. No.: 949,796

[22] Filed: Oct. 10, 1978

[51] Int. Cl.[2] ..... A43C 15/02; A43C 17/02

[52] U.S. Cl. ..... 36/67 D

[58] Field of Search ..... 36/67 D, 67 R, 59 R, 36/127

[56] References Cited

U.S. PATENT DOCUMENTS

| | | | |
|---|---|---|---|
| 1,942,574 | 1/1934 | Shapiro | 36/67 D |
| 2,161,883 | 6/1939 | Pierce et al. | 36/67 D |
| 2,207,476 | 7/1940 | Bernstein | 36/67 D |
| 2,235,774 | 3/1941 | Pierce et al. | 36/67 D |
| 2,803,070 | 8/1957 | Passidomo et al. | 36/67 D |

FOREIGN PATENT DOCUMENTS

| | | | |
|---|---|---|---|
| 624049 | 5/1949 | United Kingdom | 36/67 D |
| 736362 | 9/1955 | United Kingdom | 36/67 D |

*Primary Examiner*—James Kee Chi

*Attorney, Agent, or Firm*—Scrivener, Parker, Scrivener and Clarke

[57] ABSTRACT

It is known for sports shoes, particularly golf shoes, to have carriers anchored in their soles for receiving replaceable studs provided with screw-threaded connecting portions. The invention provides a carrier of plastics material having an internally-threaded tubular body open at least its lower end. The sole is moulded around the preformed carrier. The carrier has retaining formations to anchor it in the sole. The retaining formations comprise outwardly directed fins. That part of each fin adjacent to the body extends lengthwise, while the outer parts are less extensive and are interconnected by integral linking means, such as an annulus. The body portion extends beyond the linking means. In use the sole material envelopes the fins and the linking means.

7 Claims, 8 Drawing Figures

CARRIERS FOR STUDS FOR FOOTWEAR

This invention relates to a carrier for a stud and to an article of footwear incorporating such a carrier.

Articles of footwear for use in various games, sports and other out-door activities are often provided with studs to prevent or reduce the tendency for them to slip on the ground. The studs are of various shapes and sizes, some being blunt but others being in the shapes of spikes, and being often referred to as spikes; it is to be understood, however, that the term studs as used in this specification is intended to include both blunt studs and spike-shaped studs within its scope.

The present invention was largely developed in connection with carriers for studs for golf shoes, but the invention is not limited to carriers for that purpose and is of general applicability to carriers for studs for use with a wide variety of footwear.

A common form of golf shoe is provided with eleven carriers, each of which in use carries an associated stud. Each carrier is made from metal and is provided with an outwardly directed flange. During manufacture of the shoe the sole of the shoe is moulded from a plastics material such as polyvinyl chloride (pvc), the moulding being effected in a mould containing the carriers as inserts, so that the carriers become embedded in the finished sole and are retained in the sole by means of the flanges.

Various difficulties are encountered with the use of such carriers. One problem is that the carriers are very rigid as compared with the plastics material from which the sole is formed, with the result that when the shoe is in use and the sole flexes and yields the carriers, which do not yield, tend to apply high forces to the interior of the sole which may eventually lead to the sole being damaged and the carriers becoming loose.

Another problem is that metal carriers tend to become corroded in use. Most carriers are of the kind that include a tubular body portion which is open at its lower end and is internally screw-threaded. The stud has an externally screw-threaded portion which screws into the tubular body portion of the carrier. It often happens that the studs become worn and need to be replaced before the shoe is worn out. Nevertheless, replacement of the studs may be impossible if the carriers have meanwhile become corroded and the worn studs cannot be unscrewed from them. Attempts have been made to plate the carriers with non-corroding metals, but it has proved impossible satisfactorily to plate the internally screw-threaded portions.

An object of the present invention is to provide carriers such that these difficulties can be overcome or can at least be reduced.

The present invention consists in a carrier for a stud, the carrier being made of plastics material and comprising a tubular body portion which is open at at least one end (the lower end) and which is internally screw-threaded for receiving a complementary externally screw-threaded portion on a stud, the carrier also comprising retaining means for securing the carrier in the sole of an article of footwear during moulding of the sole, the retaining means comprising a plurality of spaced fin portions disposed around the body portion and directed outwards from the body portion, the root of each fin portion, that is the part thereof adjacent to the body portion, extending lengthwise of the body portion, and the outer parts of the fin portions, spaced from the body portion, being less extensive than the roots thereof and being interconnected by linking means integral with the fin portions, the body portion projecting lengthwise beyond the linking means.

The present invention also consists in an article of footwear having a sole made as a moulding, and having moulded into it at least one carrier in accordance with that aspect of the present invention outlined in the last preceding paragraph.

In use an externally screw-threaded portion of a stud enters the bore of the body portion of the carrier and engages the screw-thread.

The carrier is preferably made from a thermoplastics material so that it can be made by an injection-moulding process, but the material is preferably such that while it is being moulded into the sole of the article of footwear it does not soften sufficiently to become malformed. Where the sole is made from pvc, which is moulded at about 140° C., the carrier may for example be made from a acetal resin, such as that sold under the Trade Mark "Delrin", or a polyurethane, or nylon, none of which becomes malformed while it is being embedded in or anchored in the sole. Any of the plastics materials used may incorporate fillers; for example the material used may include glass fibres.

The internal thread is preferably formed during the moulding operation. The form and size of the internal thread may be such as to enable the carrier to be used with a stud of a known kind and which has a thread of standard size, the diameter thereof being about 6 mm. Alternatively it may be of some other, non-standard form or size.

Two types of carrier embodying the present invention will now be described in more detail, by way of example, with reference to the accompanying drawings in which.

Figure 5:
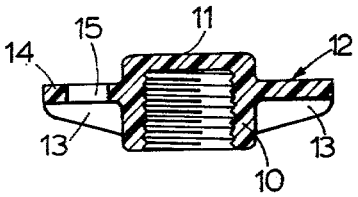
FIG. 5 is a section on the line 5—5 of FIG. 4.
Figure 6:
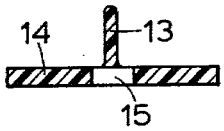
FIG. 6 is a section on the line 6—6 of FIG. 4.
Figure 7:
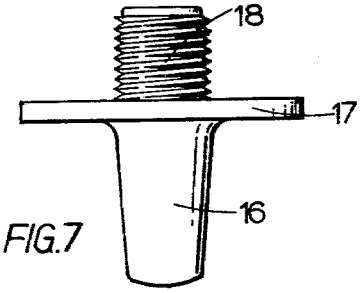
FIG. 7 is a side view of a stud suitable for releasable engagement with either of the types of carrier shown in FIGS. 1 to 6.

The carriers shown in FIGS. 1 to 6 are suitable for moulding into the sole of an article of footwear, such as a golf shoe, during formation of the sole; and the stud shown in FIG. 7 is suitable for releasable engagement in either of the carriers. Once the carriers are moulded into the sole of the article of footwear they are secured against both axial and rotational movement and cannot be removed from the sole without damaging the sole irreparably. The stud, on the other hand, can be removed and replaced as necessary.

Figure 1:
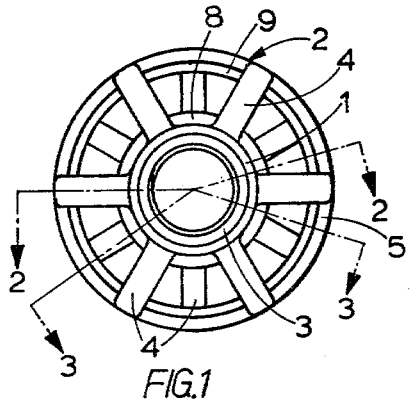
FIG. 1 is an inverted plan view of a first type of carrier.
Figure 2:
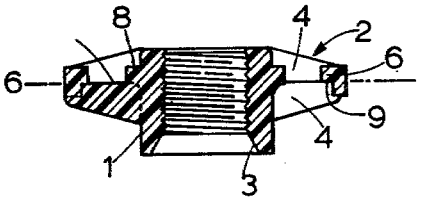
FIG. 2 is a section on the line 2—2 of FIG. 1.
Figure 3:
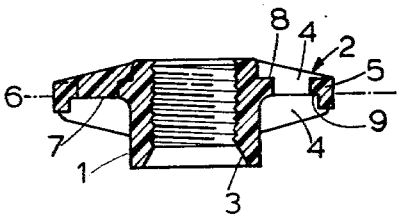
FIG. 3 is a section on the line 3—3 of FIG. 1.

Referring now to FIGS. 1 to 3 the carrier illustrated in that Figure is made as a unitary moulding of a plastics material such as "Delrin", a polyurethane, or nylon. It comprises a tubular body portion 1 and integral retaining means 2.

The tubular body portion 1 is open at both ends and is internally screw-threaded to receive the threaded portion of a stud such as a stud of the kind illustrated in FIG. 7 and described in more detail below. Although the tubular portion illustrated is open at both ends, this is not essential, and it may sometimes be advantageous for the upper end of the body portion to be partially or wholly closed by a barrier formed as an integral part of the carrier. For example the upper end of the body portion 1 may be wholly closed by a disc-shaped end plate of uniform thickness similar to the thickness of the wall of the body portion. Such an end plate may serve several useful purposes. Firstly, if the body portion is open at both ends there is a tendency for the plastics material, during manufacture of the carrier, to flow from an inlet port of the mould cavity for the carrier, to pass from the port around the body portion of the cavity in two opposite directions and to meet at a line diametrically opposite the inlet port and there to form a joint which may prove a source of weakness in the finished carrier. When the end of the body portion is closed by an end plate, however, there is a greater tendency for plastics material to flow lengthwise of the body portion so that there is less tendency for such a line of weakness to form. Secondly, when the carrier is moulded into the sole of an article of footwear, the end plate prevents material from which the sole is formed entering the interior of the body portion during formation of the sole. Thirdly, the end plate strengthens the body portion and tends to resist those forces tending to open out the body portion and thereby to release the stud.

Nevertheless, none of those advantages is of over-riding importance, and it is often preferable to leave the upper end of body portion open, as illustrated. Less plastics material is then used in manufacture of the carrier, and the overall height of the carrier is reduced by the thickness of the end cap. The internal screw-thread in the body portion 1 is preferably formed during the moulding of the carrier, though it could be formed after moulding if desired. The inner surface of the body portion 1 is chamfered at the lower end as shown at 3 to assist location of the stud during assembly of the stud with the carrier.

The retaining means comprises a plurality of fin portions 4 disposed uniformly around the body portion 1 and directed radially outwards from the body portion 1. There are open gaps remaining between adjacent fin portions. The root of each fin portion 4, that is the part thereof adjacent to the body portion 1, extends lengthwise of the body portion, parallel with the axis of the body portion. The outer parts of the fin portions, spaced from the body portion 1, are less extensive than the roots thereof and are linked together by linking means integral with the fin portions and constituted by an annular portion 5 co-axial with the body portion but spaced radially away from the body portion.

Each fin portion 4 is of substantially triangular shape as seen in side view. There are twelve fin portions in all, and they lie on opposite sides of a plane 6 normal to the axis of the body portion 1. Alternate fin portions lie on one side of said plane, and the remaining fin portions 1 lie on the other side of said plane. Each fin portion has a flat surface 7 lying in the plane 6.

The body portion 1 is formed with an annular collar 8 of the cross-section illustrated, and the lower inner edge of the annular portion 5 is formed with an annular rebate 9.

It will be seen from FIGS. 2 and 3 that the body portion 1 extends downwards beyond the retaining means 2. It is intended that the lower surface of the sole moulded around the carrier should be flush with the lower end of the carrier, in which case the material from which the sole is formed extends to form an unbroken layer beneath the fin portions 4. It is also intended that the upper surface of the sole should be spaced above the level of the upper end of the carrier so that above the carrier there is a continuous layer of the material from which the sole is formed.

When the carrier is moulded into the sole of an article of footwear the retaining means is thus entirely embedded inside the sole. The fin portions 4 strongly resist any tendency to axial and radial movements of the carrier, while the annular portion 5 resists any tendency for the intermediate part of the body portion to expand or burst radially outwards under the influence of the forces applied to it by the stud in use.

The arrangement of the whole retaining means 2 is such that during formation of the sole the material from which the sole is formed can flow around and between the fin portions 4 so as to assist in locking the carrier to the sole and to prevent its rotating in the sole or being pulled out of the sole.

Figure 4:
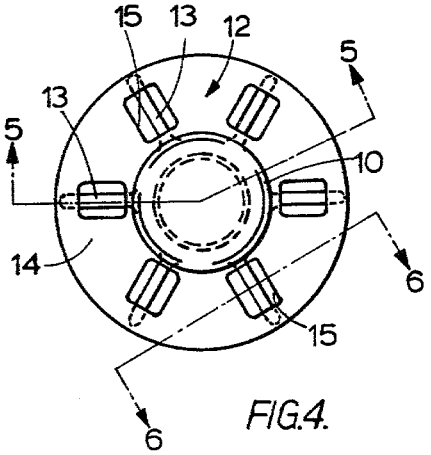
FIG. 4 is a plan view of a second type of carrier.

In an alternative construction of carrier, shown in FIGS. 4 to 6, the carrier comprises an internally threaded tubular body portion 10 closed at its upper end by integral end plate 11, and retaining means 12. The retaining means 12 comprises fin portions 13 and linking means in the form of a flange 14 formed with apertures 15. There are six uniformly spaced fin portions 13 directed radially outwards from the body portion 10. The root of each fin portion extends lengthwise of the body portion, but the axial dimension of each fin portion becomes progressively less with progressively increasing distance from the body portion, in a manner similar to the fin portions 4. The outer parts of the fin portions 13 are integrally joined to the flange 14. As with the carrier shown in FIGS. 1 to 3 the body portion extends downwards beyond the retaining means. When the sole of an article of footwear is moulded around the carrier, material from which the sole is made can flow between the fin portions 13 and through the apertures 15.

Figure 8:
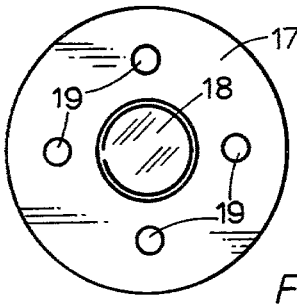
FIG. 8 is a plan view of the stud shown in FIG. 7.

Referring now to FIGS. 7 and 8, the stud shown in those Figures is formed from steel as a unitary whole, and is plated to resist corrosion. The stud has a ground-engaging portion 16, a flange 17 and a screw-threaded portion 18. Four through holes 19 are formed in the flange 17.

In a preferred method of manufacturing the article of footwear, or at least the sole of the article of footwear, a stud is first screwed into each of the carriers to be incorporated in the sole, and the combined studs and carriers are then mounted as inserts in the mould in which the sole is to be formed. The axial length of the screw-threaded portion 18 of the stud is substantially the same as the axial length of the body portion of the carrier so that when the stud is screwed as far as possible into engagement with the carrier the upper end of the portion 18 is flush with the upper end of the carrier and serves as a closure for that end. The ground-engaging portion 16 of each stud enters a recess of complementary shape in the bottom of the mould for the sole. When the material from which the sole is to be made enters the mould it flows around the carriers as described above and flows through the gaps in the retaining means. As the tubular body portion of each carrier projects axially lengthwise, beyond the linking means, that is the annular portion 5 or the flange 14, the sole-forming material is able to embrace the linking means from above and beneath. The material is, however, prevented from entering the interior of the tubular body portion 1 due to the presence there of the portion 18 of the associated stud. The sole-forming material also enters the holes 19 in the flange 17 of each stud. Thus, when the completed sole is removed from the mould short pips of material projects from the underside of the main part of the sole and into the holes 19. These pips serve to resist any tendency there may be for the studs to become unscrewed in use.

When a stud becomes worn it can, of course, be unscrewed and replaced. In a preferred method use is made of a tool having four cylindrical pegs which can be pushed into the holes 19 from beneath, thus pushing the pips resiliently upwards and freeing them from the holes. The stud can then be unscrewed readily and can be replaced by a new, unworn stud. If the pips are not pushed out of the holes before the worn stud is unscrewed an increased torque must be applied to the stud, and the pips may be sheared from the main part of the sole or may at least be damaged. The replacement stud is held in place largely by friction though the pips or their remaining parts may assist. In addition, or alternatively, the upper face of the flange 17 may have formations which in engagement with the sole resist those forces tending to unscrew the stud.

Other forms of studs may equally well be used with the carrier, that illustrated in FIGS. 7 and 8 being shown merely by way of example.

When the carriers are first assembled with the studs, before insertion into the mould for the sole, it is necessary to ensure that the studs are the lower ends of the carriers rather than into their upper ends. To avoid incorrect assembly the upper ends of the tubular body portions may be closed, as described above. Alternatively the upper end of each body portion may be partially closed, as by an inwardly directed flange or projection.

Although it is much preferred to assemble the studs and carriers before the sole is moulded, this is not essential. It would be possible to mount the carriers alone in the mould for the sole and to screw the studs into the carriers after formation of the sole and after its removal from the mould.

What is claimed is:

1. A carrier for a stud for a moulded sole of an article of footwear comprising a tubular body portion of moulded plastics material which is open at at least its lower end and which is internally screw-threaded for receiving a complementary externally screw-threaded portion on a stud, said carrier including retaining means for securing the carrier in the moulded sole of an article of footwear during moulding of the sole, the retaining means comprising a plurality of spaced fin portions disposed around the body portion and directed outwards from the body portion, the root of each fin portion adjacent to the body portion being integral with and extending axially lengthwise of the body portion, and the outer parts of the fin portions, spaced from the body portion, being less extensive axially than the roots thereof and being interconnected by linking means integral with the fin portions, the body portion projecting axially lengthwise beyond the linking means.

2. A carrier according to claim 1 in which the axial dimension of each fin portion becomes progressively less with progressively increasing distance from the body portion.

3. A carrier according to claim 2 in which the fin portions terminate at a plane normal to the axis of the body portion, alternate fin portions lying on one side of said plane and the remaining fin portions lying on the other side of said plane.

4. A carrier according to claim 1 in which the linking means comprises an annular portion coaxial with the body portion but spaced radially away from the body portion.

5. A carrier according to claim 1 in which the linking means comprises an apertured flange projecting outwards from the body portion.

6. A carrier according to claim 1 in which the carrier projects downwards beyond the retaining means.

7. An article of footwear having a sole made as a moulding, and having moulded into the sole at least one carrier in accordance with any one of the preceding claims.

* * * * *